US006007463A

United States Patent [19]

Wells et al.

[11] Patent Number: 6,007,463

[45] Date of Patent: Dec. 28, 1999

[54] TRICEPS EXERCISE APPARATUS

[76] Inventors: Lisalee Ann Wells, 5220 Vista Hermosa, Long Beach, Calif. 90815; Jeanette Gordon, 6738 Halm Ave., Los Angeles, Calif. 90056

[21] Appl. No.: 08/846,660

[22] Filed: May 1, 1997

[51] Int. Cl.[6] ..... A63B 21/02

[52] U.S. Cl. ..... 482/126; 482/74; 482/122; 482/124

[58] Field of Search ..... 482/74, 121, 122, 482/124, 126

[56] References Cited

U.S. PATENT DOCUMENTS

| | | | |
|---|---|---|---|
| 2,035,010 | 3/1936 | Rawlings | 482/124 |
| 4,337,938 | 7/1982 | Rodriguez | 482/124 |
| 4,456,249 | 6/1984 | Calabrese | 482/124 |
| 5,176,600 | 1/1993 | Wilkinson | 482/124 |
| 5,431,617 | 7/1995 | Rattray, Jr. | 482/121 |
| 5,514,059 | 5/1996 | Romney | 482/121 |
| 5,681,248 | 10/1997 | Vani | 482/124 |

*Primary Examiner*—Lynne A. Reichard
*Attorney, Agent, or Firm*—Daniel L. Dawes

[57] ABSTRACT

Disclosed is a triceps exercising apparatus. A support harness comprises a neck band and pectoral flaps extending from the neck band in each direction. The neck band and pectoral flaps may be configured together as a unitary structure or as separate structures. In either case, the neck band is placed at the rear of the base of the user's neck, and the support harness is draped over both of the user's shoulders, so that each pectoral flap rests over one of the clavicles. Attached to each pectoral flap and descending therefrom is an elongated elastic element, such as a bungee cord. The lower end of each elastic element is secured to a D-shaped hand stirrup. In embodiments in which the elastic elements are bungee cords, the upper hook of one cord is looped over a hook secured to the lower portion of each pectoral flap, and the lower look is looped over the top of the respective hand stirrup. In various embodiments, the support harness may be padded or may comprise individual structures surrounding a central, flexible band. Additionally, a plurality of elastic elements may be provided to yield increased tension (i.e., resistance to extension).

23 Claims, 3 Drawing Sheets

TRICEPS EXERCISE APPARATUS

BACKGROUND OF THE INVENTION

1. Field of the Invention

This invention relates to the field of exercise apparatus, and more particularly to apparatus for building and strengthening, or trimming and toning, the triceps muscles.

2. Description of Prior Art

Physical fitness and exercise are increasingly—and deservedly—important to a large segment of the population. With advances in medical science, which have increased the average human life expectancy, there is a natural interest in improving the quality and enjoyment of life during this increased lifespan. Thus, an increasing number of people look to exercise as a means of improving their appearance, health and sense of well-being.

There are, of course, a host of exercise devices now available. At one end of the scale are complex machines which, by user selection and adjustment, can be used in a number of individual exercise routines to develop, strengthen, tone or trim virtually every muscle group. However, such apparatus are generally large, bulky and—perhaps perhaps most importantly—frequently quite expensive.

Certainly, one might join a gym or exercise club to gain access to such complex apparatus. However, many people lack the time, money or freedom to join a gym or exercise club. For example, mothers—particularly working mothers—have such great demands on their time that such formal exercise sessions can be an unavailable luxury. And there are others who simply choose not to exercise in public, preferring rather to confine such activities to the privacy of their own homes, according to their own schedules, and integrating them into their personal lifestyle.

For such individuals, there are many options, including smaller-scale, relatively inexpensive, special purpose devices. For example, if only the wrist and forearm are to be exercised, one might purchase a spring-loaded hand grip and use it while watching television, reading or conversing.

For those who wish primarily to exercise their triceps, but wish to move beyond the simple pushup, ordinary pushup bars are readily available. These are usually fabricated from tubular metal and consist of three pieces. The first is the gripping region, consisting of a top, straight portion, both of whose ends are bent at a 90° angle from the straight portion to form a wide, inverted U-shaped structure. Each end is secured to a base, which consists usually of another tubular metallic structure with rubber caps on either end (to prevent slippage, injury to the user and scratching). Each end of the gripping region is introduced transversely to its respective base and secured to it, usually with a thumbscrew. When the apparatus is fully assembled, each end of the gripping region forms a T-shaped structure with its respective base, which extends in either direction, transversely from the plane of the wide U-shaped gripping region. Typically, the top portion of the gripping region is covered by a compliant (usually, foam rubber) sleeve, to improve the user's grip and to provide a level of comfort.

In use, a pair of pushup bars is gripped by the user at the top portion of each gripping region. The user then assumes a supine position on the floor. Each bar is drawn to its respective side of the body, with the two bases of each pushup bar brought into complete, solid contact with the floor. In the rest position, the user's chest contacts the floor, while the elbows are strongly bent and point backward. The user's elbows are then unbent, thus raising the chest from the floor. If the body is relatively stiff, most of the force employed to raise the body to this second position is supplied by contraction of the upper arm, particularly the triceps, and pectoral muscles.

These muscles are used both to elevate the body and to ease it back to the rest position. Since the entire weight of the upper body is being raised and supported, and—if the body remains relatively stiff—part of the lower body weight as well, this can be a very demanding exercise. But the rewards are great, in rapid development and strengthening of the pectorals and, particularly, the triceps However, pushup bars present two major drawbacks.

First, one must cyclically raise and lower the body from and back to the floor. In a strenuous exercise such as this, with accompanying heavy breathing, a great deal of air will be drawn into the lungs from the vicinity of the floor. And even in the cleanest of homes, carpets can contain dust, dust mites (and their residue) and pet dander. Breathing such items during a strenuous exercise session can make the activity more unpleasant than it should be, not to mention the great potential for serious allergic reactions in many people. Many women of average fitness simply lack the upper body strength to perform even a single pushup.

The second problem with pushup bars is the fact that many women wish to trim and tighten their triceps, rather than develop them. It is not strength that such individuals seek, but rather an attractive appearance, particularly while wearing sleeveless clothing. Such women are primarily interested in a high repetition, low-tension exercise routine, rather than the "bodybuilding", high-tension regimen ordinarily provided by pushups and pushup bars.

What is needed to answer both of these needs is an inexpensive and portable triceps-specific exercise device which can be used in a seated or standing position, in the privacy of one's own home, which can selectively provide either high-tension exercise, for building and strengthening the triceps (and, possibly, other muscle groups), or low-tension exercise for tightening and trimming them.

BRIEF SUMMARY OF THE INVENTION

The invention is a triceps exercise apparatus which is supported by the rear base of the neck and, to some extent, the shoulders of the user. The basic support element is a hard neck band, which is placed around the base of the back of the user's neck and draped over the shoulders. Projecting from the neck band on each side, is a segmented pectoral flap, one of which lies over each of the users clavicles. Attached to the lower end of each pectoral flap is an elastic element which, at its lower end, is secured to a D-shaped hand stirrup, which the user grips.

With proper adjustment (of the effective length of the elastic element), the users elbow will be bent at approximately a 90° angle when in the rest position. The arm is then straightened, until the upper arm and forearm are nearly aligned, and then it is re-bent, returning to the rest position. Both arms should be moved simultaneously. This cycle is repeated as many times as desired. With an elastic element of relatively low stiffness (i.e., with a low spring constant, providing a relatively low level of resistance to linear extension), repetition of this procedure is a low-tension, triceps trimming and tightening exercise. With a stiffer elastic element (i.e., one which is relatively more resistant to extension), it can be a high-tension, triceps building and strengthening exercise, with positive effects also on other adjacent or supporting muscle groups.

DETAILED DESCRIPTION OF THE PREFERRED EMBODIMENTS

Figure 1:
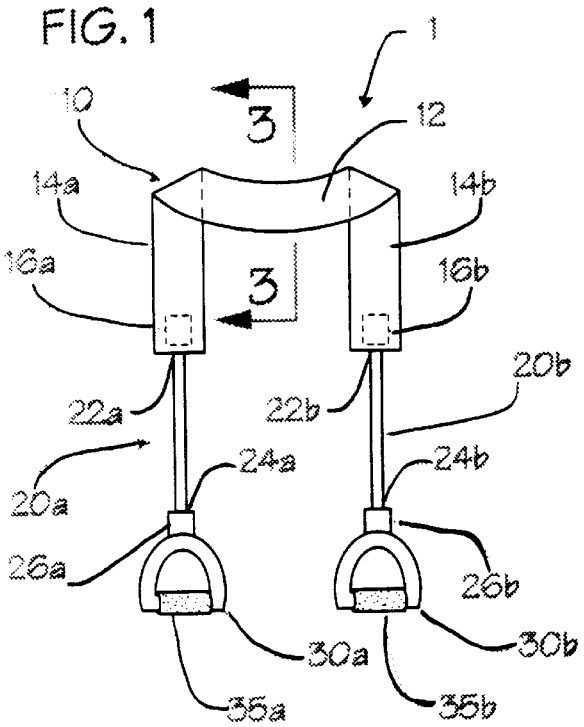
FIG. 1 is a rear elevation generalized view of principal embodiment of the invention.

Turning now to FIG. 1, the triceps exerciser 1 of the invention will first be described generally. For convenience, where an element of the triceps exerciser 1 is in proximity to the user's left side, as shown in the Drawing, and where such element has a corresponding element on the user's right side, that left element will be designated with the identification letter "a", while the corresponding right-hand element will be designated "b", both being applied to the same identification numeral. Thus, for example, "elastic element 20*a*" refers to the elastic element associated with the user's left side, as depicted in the Drawing, while "elastic element 20*b*" refers to the corresponding element associated with the user's right side. In specific reference to an element shown on only one side of the user, in a particular Fig. of the Drawing, where it is stated or implicitly understood that a corresponding element is associated with the other side of the user, no such letter will be used with the identification numeral.

Figure 2:
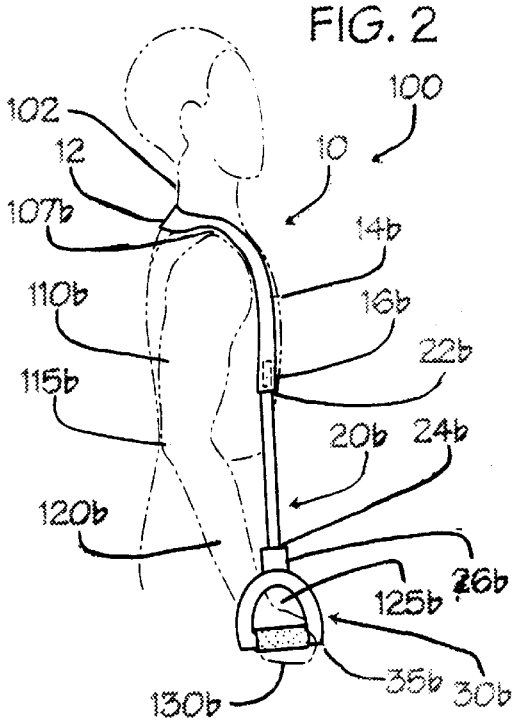
FIG. 2 is a side elevation generalized view of the embodiment shown in FIG. 1.
Figure 9:
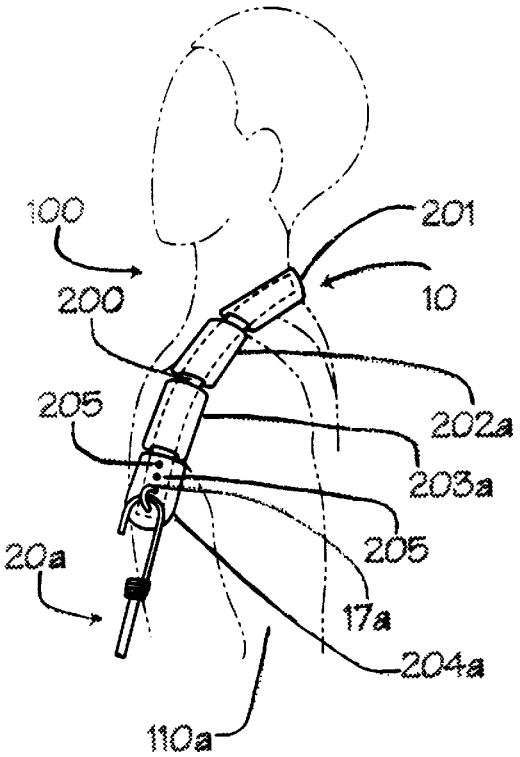
FIG. 9 is a side elevation view of an alternative embodiment of the support harness.
Figure 10:
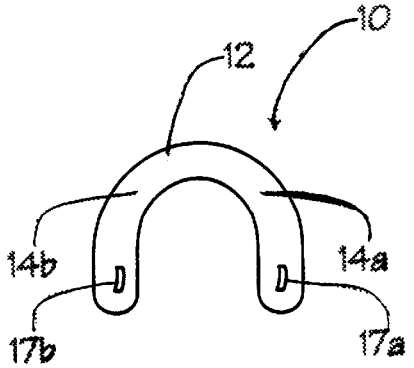
FIG. 10 is a simplified plan view of the support harness of another embodiment of the invention.

The principal support element of the support harness 10 is the neck band 12, which is draped around the base of the neck of the user. The support harness 10 extends from both ends of the neck band 12 into pectoral flaps 14*a,b*. These pectoral flaps 14*a,b* may merely be flexible extensions of the material comprising the neck band 12, itself, as shown in FIGS. 1, 2 and 10. Alternatively, they may be segmented elements secured to the neck band 12 at either end thereof, or, as shown in FIG. 9, they and the neck band 12 may together be sequentially held by a single, flexible underlying connective member. In any event—again, referring particularly to FIG. 1—the left pectoral flap 14*a* is draped over the user's left shoulder and across the left clavicle, and the right pectoral flap 14*b* is similarly draped over the user's right shoulder and across the right clavicle.

Near the lower end of each pectoral flap 14*a,b* is an upper attachment element 16*a,b,* shown in phantom generalization in FIG. 1. As described below, particularly in reference to FIGS. 4, 6, 7 and 8, this upper attachment element 16*a,b* may take a number of forms in specific embodiments of the invention.

Again referring to FIG. 1, the upper end 22*a,b* of the elastic element 20*a,b* is attached to its respective upper attachment element 16*a,b*. The elastic element 20*a,b* extends downward from the support harness 10 (i.e., from its respective pectoral flap 14*a,b*), until its lower end 24*a,b* is attached to its respective lower attachment element 26*a,b,* again shown in generalized form in FIG. 1. This lower attachment element 26*a,b* secures the lower end 24*a,b* of the elastic element 20*a,b* to its respective hand stirrup 30*a,b*.

FIG. 2 shows, in a side view portraying the user 100 in phantom, the manner in which the triceps exerciser 1 of the principal embodiment of the invention is draped over the user 100 and held in extended position. It will again be noted, now in reference to FIG. 2, that the neck band 12 is placed behind the neck 102 of the user 100. The right portion of the support harness 10 then extends around the neck 102 of the user 100 and over the right shoulder area 105*b*. The right pectoral flap 14*b* rests on the user's right clavicle 107*b*. The remaining elements are as described in reference to the depiction in FIG. 1, and, of course, the left-side elements (designated "a") are symmetrical.

In the configuration shown in FIG. 2, the triceps exerciser 1 is in the extended position—i.e., the position in which the user 100 feels maximum tension. As described above, in this position, the right elbow 115*b* is almost completely extended, thus nearly aligning the right upper arm 110*b* with the right forearm 120*b*, while the right wrist 125*b* extends through the lower bar 35*b* of the right hand stirrup 30*b* with the right hand 130*b* grasping the handle of this stirrup.

Of course, the user 100 could completely extend the right elbow 115*b*, thus completely aligning the right forearm 120*b* with the right upper arm 110*b*. But this will not normally be done, particularly by those who wish a high repetition, low-tension exercise routine for thinning and toning the triceps, rather than a high-tension one for strengthening and developing this muscle. Also, it is assumed that, typically, both arms will be exercised simultaneously, to provide stability (i.e., to prevent slippage of the triceps exerciser 1 from its secure, centralized position), and to yield symmetric results in the user's triceps.

However, another embodiment of the invention could easily be devised by one of ordinary skill, in the light of present exercise technology, in which, for example, a cord leads from the left pectoral flap 14*a,* for secure attachment of the other end of the cord to the right pectoral flap 14*b*. By proper adjustment of the length of such a cord and secure attachment at both ends to the respective pectoral flaps 14*a,b,* one could exercise one arm at a time, while perhaps resting the other wrist 125*a,b* in the lower bar 35*a,b* of the hand stirrup 30*a,b* not then being used, without causing the support harness 10 to slip off the shoulder. But, again, use of the triceps exerciser 1 of the invention will normally and most efficiently be symmetric, with both arms being exercised simultaneously.

Figure 5A:
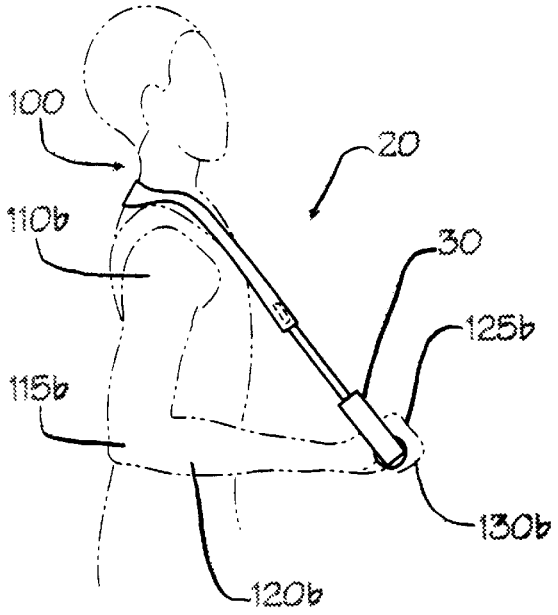
FIG. 5*a* is a generalized side elevation view of a user employing the triceps exerciser of the invention, in rest position.
Figure 5B:
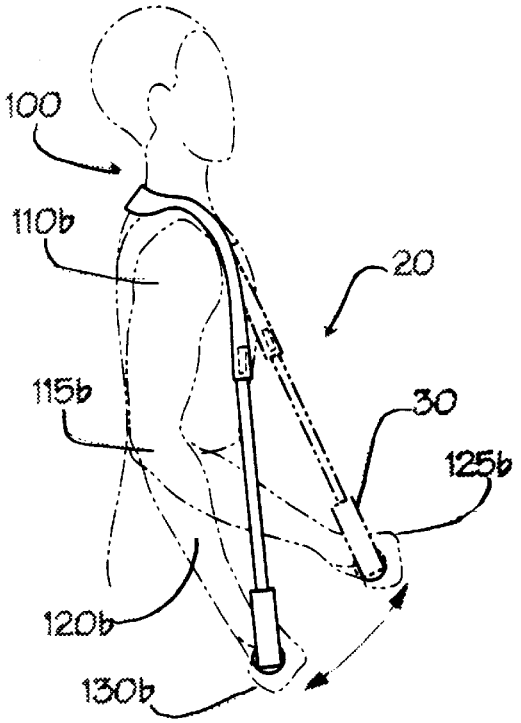
FIG. 5*b* is a generalized side elevation view of a user employing the triceps exerciser of the invention, in extended position.

FIGS. 5*a* and 5*b* illustrate the two end positions (i.e., rest, and maximum tension, respectively) of the exercise cycle in a simplified manner. In FIG. 5*a*, the right elbow 115*b* is bent at approximately a 90° angle. This is the rest position. In FIG. 5*b*, the right elbow 115*b* is almost fully extended. This is the extended, maximum tension position. Of course, as has been previously stated, the right elbow 115*b* could have been completely extended, thus exactly aligning the right upper arm 110*b* with the right forearm 120*b*. But that position might create more strain on the triceps than most users—particularly women who seek only to trim and tighten the triceps, rather than strengthen and develop them—might wish. Thus, the extension position shown in FIG. 5*b* would probably more nearly conform to practice. To illustrate the difference between the two end positions, FIG. 5*b* also shows the rest position in phantom, with arrows denoting the movement between the two end positions.

Figure 3:
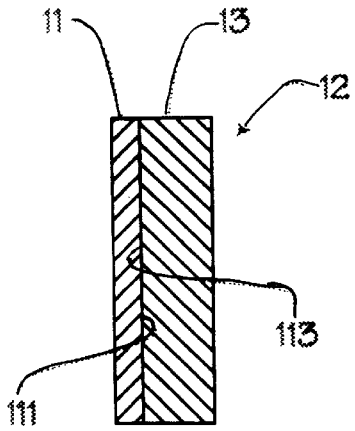
FIG. 3 is a sectional view of the neck band, along section lines 3—3 in FIG. 1, according to an embodiment of the invention.

Turning now briefly to FIG. 3, it can be seen that, in the principal embodiment of the triceps exerciser 1, the neck band 12 comprises two layers. The center layer 11 provides strength and durability to this element, and may be fabricated from any reasonably tough substance, such as plastic, leather, canvas or a woven band. Normally, it is also preferable to construct this upper layer 11 from a flexible substance, so that it can drape comfortably below the neck 102 and over the shoulders 105*a,b* of the user 100. The entire support harness 10 could also conceivably be implemented as a single (i.e., unitary) structure of a semi-rigid material, as shown in FIG. 10. But selection of the material from which to construct the neck band 12 for the particular application is well within the ability of the ordinary skilled practitioner, in light of these teachings and, thus, need not be described in further detail. The principal embodiment of the triceps exerciser 1 contemplates that the center layer 11 described above will be imbedded in a semirigid plastic in bright colors; the plastic will be segmented, with short portions of the center layer 11 remaining unembedded to provide necessary flexibility, which will, in turn, accommodate differences in configuration of clavicle, neck, pectoral muscle alignment and arm length.

An additional layer 13 for the neck band 12 constructed of a compliant material, such as foam rubber, may be bonded to the upper layer 11 by cementing or other conventional means, if he main segments are fabricated of a rigid plastic. The purpose of this compliant lower layer 13 is to provide additional comfort to the user 100 while employing the triceps exerciser land, particularly if a non-skid material such as foam rubber is used, to prevent slippage of the support harness 10. The inner surface 111 of the upper layer 11 (i.e., the lower surface shown in FIG. 3) is, of course, the one to which the outer surface 113 of the lower layer 13 is bonded.

However, it is entirely possible to implement the neck band 12 by use of only a single layer of material, provided that it is sufficiently tough to provide needed strength and sufficiently pliant to provide necessary flexibility and comfort. Certainly, the ordinary skilled practitioner, in light of the teachings herein, can properly construct the neck band 12.

As previously stated, the pectoral flaps 14*a,b* may be implemented merely as integral extensions of the neck band 12, as shown in FIGS. 1, 2 and 10 (i.e., providing a unitary support harness 10), or as one or more segmented attachments thereto on either side, where adjacent segments might be mutually attached by means of hooks or other means well within the skill of the ordinary practitioner, in light of these teachings. In any case, all or any portion of the support harness 10 might be padded in the manner described above and shown in FIG. 3. And, as shown in FIG. 9, the support harness 10 might even comprise a central band 200 (of, for example, canvas, leather or some type of woven strapping) surrounded by segments of padding elements 201, 202*a*, 203*a*, 204*a*. In this embodiment, the initial padding element 201 is slideably mounted on the central band and corresponds to the neck band 12. The final padding element 204*a* is, in effect, the pectoral flap 14*a*, which is secured to the central band 200 by the grasping hook or loop 17, which passes through it and is suitably mounted on the opposite side. The intervening padding elements 202*a*,203*a* are slideably mounted onto the central band in order to provide adjustability. Each of these padding elements 201,202*a*, 203*a*,204 may be constructed of molded plastic or a foam material surrounded by a protective layer of nylon or other tear-resistant flexible material.

Finally, as suggested above, while it might be desirable to implement the support harness 10 as a flexible member (or members), to facilitate conformity to the contours of a wide variety of users and to provide a degree of comfort in use, the support harness could be rigid, perhaps molded from a single piece of plastic, as shown in FIG. 10, where the grasping hooks or loops 17 are integral with or suitably bonded to the structure at the proper locations. Such a rigid support harness 10, as shown in FIG. 10, would require substantial foam padding bonded to its entire inner surface, as shown in FIG. 3 (in respect of the neck band), to provide a suitable degree of comfort and positional stability.

Since provision of separate pectoral flaps 14*a,b* for attachment to the neck band 12, or implementation of the support harness 10 as a sequence of padded envelopes 201–204 around a central band 200—as opposed an integral neck band 12 and pectoral flaps 14*a,b,* (whether constructed of flexible or rigid material, and whether or not padded)—is merely a design application choice well within the skill of the ordinary practitioner, no further mention will be made of such possible alternative implementations. Nevertheless, it should be understood that reference, in this Specification or in the claims appended hereto, to pectoral flaps "extending" from a neck band refers equally to integral, connected or segmented pectoral flaps of any suitable material or construction.

The purpose of the support harness 10 of the invention, in any particular implementation, is essentially to support the elastic elements 20*a,b* by extending from the base of the rear of the neck over both shoulders, to rest across both clavicles.

Figure 4:
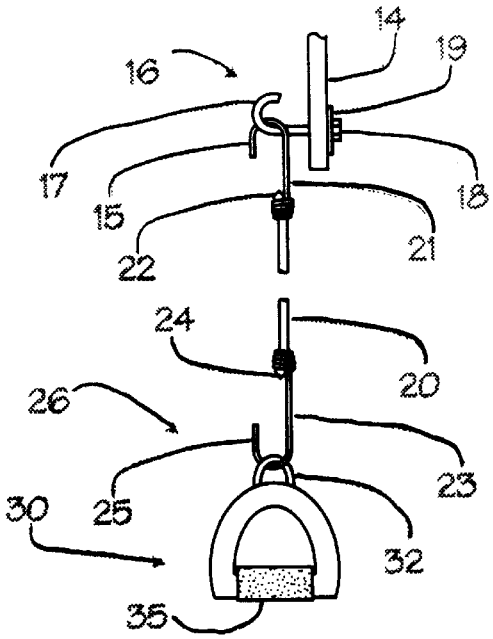
FIG. 4 is a side elevation view of the lower portion of the triceps exerciser of the invention, according to the principal embodiment.

FIG. 4 illustrates the manner in which the elastic element 20 of the triceps exerciser 1 is configured and attached in the principal embodiment of the invention. It is again to be understood that all structures described in reference to FIG. 4 exist symmetrically on both sides of the triceps exerciser 1, and that, therefore, reference letters "a" and "b" are not used in this context.

Here, the elastic element 20, itself, may consist of an ordinary bungee cord 20, with an upper end 22 and an upper hook 15 (i.e., the terminal, curved portion of the upper cord stay 21) securely grasping it and projecting beyond it, and a lower end 24 and a lower hook 25 (the curved portion of the lower cord stay 23) likewise securely grasping and projecting beyond it. In this embodiment, the upper attachment element 16, shown in generalized fashion in FIG. 1, comprises a grasping hook 17 whose shank portion passes through the pectoral flap 14 and is secured at the opposite side to prevent force from the upper hook causing the grasping hook 17 to pull through the hole through which it passes. The preferred elastic, or tension-bearing member of the apparatus would be a solid length of black, rib-edged rubber, configured at each end to accept a grasping hook 17 for affixing to the lower end 24 of the pectoral segments and for affixing to the hand stirrup 30.

Figure 6:
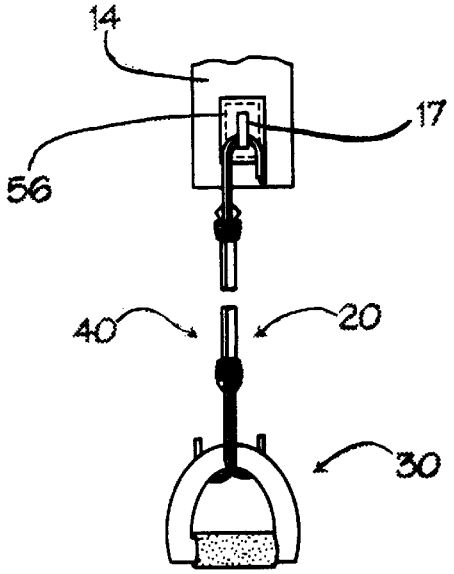
FIG. 6 is a side elevation view of the lower portion of the triceps exerciser of the invention, according to an alternative embodiment.

Although the configuration of the grasping hook 17 shown in FIG. 4 would serve the purpose without the addition of further elements, it would perhaps provide additional comfort to the user 100 if the inner portion (i.e., that side resting across the users clavicle 107) were padded or countersunk to prevent chafing. Also, if the support harness 10 is constructed of a flexible material such as leather, canvas or a woven material, the grasping hook 17 could be suitably attached to a patch 56 of a similar material, and that patch could be sewed or fabricated onto the pectoral flap 14*a,b*, as shown in FIG. 6. Of course, there are other ways to prevent chafing, including providing a grasping hook 17 which is supported by a plate which is coupled or riveted to the lower portion of the pectoral flap 14, or, in the embodiment of the support harness shown in FIG. 10, molded integrally with the support harness.

Figure 7:
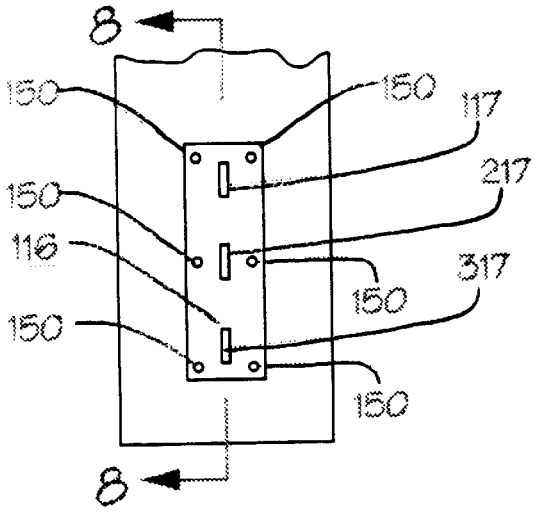
FIG. 7 is a plan view of the upper attachment element, according to an alternative embodiment of the invention.
Figure 8:
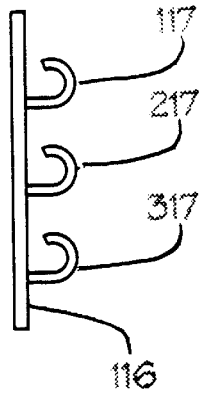
FIG. 8 is a sectional view of the upper attachment element shown in FIG. 7, through section lines 8—8.

For example, in the embodiment shown in FIGS. 7 and 8, the grasping hook 17 is actually a series of grasping hooks 117, 217, 317, placed sequentially along a support bar 116. The grasping hooks 117, 217, 317 may be soldered to the support bar 116, if both are of suitable metal, unitarily molded into or from a strong plastic or even integral with the support harness 10 (in the manner of the single grasping hook 17 shown in FIG. 10). If it is not integral with the support harness 10, the support bar 116 (or the integrated structure) can be secured to the pectoral flap 14 by any suitable number and placement of rivets 150.

By providing a sequence of grasping hooks 117,217,317, the particular embodiment of the triceps exerciser 1 illustrated in FIGS. 7 and 8 allows a standardized length of the elastic element 20 to be employed by users whose upper arms 110 and forearms 120 are relatively longer or shorter than other users, simply by selecting the most convenient one of the multiple grasping hooks 117, 217, 317 for attachment of the elastic element 20. This is particularly simple if the elastic element 20 is a bungee cord, as illustrated in FIGS. 4 and 6, as the user has merely to loop the upper hook 15 over the correct one of the grasping hooks 117, 217, 317. Perhaps needless to say, provision of multiple grasping hooks 117, 217, 317 facilitates manufacture of a virtually "one size fits all" triceps exerciser 1. But even in the bungee cord embodiment of the elastic element 20, the proper length of bungee cord could easily be selected by the user if only a single grasping hook 17 is provided.

Referring to FIG. 4, the lower end 24 of the elastic element 20 is attached to the hand stirrup 30 by lower attachment means 26. This lower attachment means 26 is shown in generalized depiction in FIG. 1. However, with reference to FIG. 4, which illustrates the bungee cord embodiment of the elastic element 20, the nature of this lower attachment means 26, in the principal embodiment of the invention, may be discussed in some detail. Here, the lower end 24 of the elastic element 20 (i.e., the bungee cord) is held by a lower cord stay 23, which terminates in a lower hook 25. Attachment of the elastic element 20 to the hand stirrup 30 is accomplished merely by looping the lower hook 25 through the upper loop 32 of the hand stirrup 30. In fact, this upper loop 32 could be dispensed with entirely, and the lower hook 25 looped over the body of the hand stirrup 30, itself. However, provision of such an upper loop 32 is believed to provide smoother operation, particularly if the triceps exerciser 1 is used in an exercise routine comprising a long series of rapid cycles of tension and relaxation.

Although the elastic element 20, in one embodiment of the invention, is merely an ordinary bungee cord, it is to be understood that a wide variety of linearly elastic devices could substitute for a bungee cord. Included might be a metallic spring, encased by a flexible sleeve to prevent pinching of the user's skin during exercise. In such a case, the sleeve could be fabricated from any suitable material, such as leather, mylar or canvas. And the spring constant could be selected to provide any desired stiffness, depending on the proposed result of the exercise program.

Alteratively, ordinary rubber tubing could be employed as the elastic element 20, and this could be clamped, respectively, to the grasping hook 17 and to the upper loop 32 of the hand stirrup 30 (or directly onto the hand stirrup 30, at its upper portion). Alternatively, a number of rubber tubes could be employed, in parallel, to provide a selected level of net resistance. In any event, rubber tubing, as the implementation of the elastic element 20, has the advantage of being able to be provided in one substantial length, to be custom ordered or cut by the user into two (or a multiple of two) pieces to provide an elastic element 20 for each side of the triceps exerciser 1 which is of the desired stiffness and length for the individual user.

FIG. 6 illustrates another of these alternative embodiments, in which a pair of ordinary bungee cords 20,40 is substituted for the single bungee cord 20 of the principal embodiment. This alternative embodiment presents a rather simple way to increase the stiffness provided by the triceps exerciser 1, e.g., in applications where it is desired to develop and strengthen the triceps, rather than merely to trim and tighten them. It will be noted that in this embodiment, as illustrated in FIG. 6, the upper loop 32 of the hand stirrup 30 (shown in FIG. 4) is eliminated, since, as mentioned above, the triceps exerciser 1 will function nearly as well without it.

Certainly, other suitable elastic elements 20 could be devised by an ordinary skilled practitioner. And likewise, attachment of any such alternative elastic elements 20 to the pectoral flaps 14*a,b* and to their respective hand stirrups 30*a,b* would not present a problem to such a practitioner, in the light of the present teachings.

The hand stirrups 30 may be constructed of any suitable material, such as nylon (or other plastic material), rubber (hard or flexible) or aluminum, or a combination thereof. To provide a firm grip and a degree of comfort, the lower bar 35 of each hand stirrup might be padded or shaped to provide a suitable contour for a comfortable grip.

With increased resistance in the elastic element 20, the triceps exerciser 1 can function as a reasonably practical alternative to pushup bars. Of course, no two exercise devices of differing design can provide identical results, in terms of muscle groups or individual muscles exercised. However, the fact that a high-tension embodiment of the triceps exerciser 1 causes the neck, upper back and pectoral muscles, as well as the triceps, to resist the force generated by the extended elastic element 20 suggests that a high-tension embodiment of the triceps exerciser could exercise some of the same muscle groups as would pushup bars, namely, muscles in the upper arm, upper chest, neck and upper back.

It may, by now, be readily seen that the practitioner of ordinary skill, having carefully reviewed the teachings herein given, may modify the triceps exerciser 1 in a vast number of ways, to suit particular circumstances - all within the scope of the invention. Therefore, it must be understood that the illustrated and described embodiments have been set forth only for the purpose of example and that these should not be taken as limiting the invention as defined by the claims which follow.

The words used in this Specification to describe the invention and its various embodiments are to be understood not only in the sense of their commonly defined meanings, but also to include, by special definition in this Specification, structures, materials or acts beyond the scope of the commonly defined meanings. Thus if an element can be understood in the context of this Specification as including more than one meaning, then its use in a claim must be understood ad being generic to all possible meanings supported by the Specification and by the word itself.

The definitions of the words or elements of the following claims, therefore, include not only the combination of elements which are literally set forth, but all equivalent structures, materials or acts for performing substantially the same function in substantially the same way to obtain substantially the same result.

Insubstantial departures from the claimed subject matter as viewed by a person with ordinary skill in the art, now known or later devised, are expressly contemplated as being equivalently within the scope of the claims, even though not performing exactly the same function in substantially the same way to obtain substantially the same result. Therefore, substitutions now or later known to one with ordinary skill in the art will be within the scope of the defined elements.

The claims are thus understood to include what is specifically illustrated and described above, what is conceptually equivalent, what can be obviously substituted and also what essentially incorporates the essential idea of the invention.

We claim:

1. An apparatus for exercising the triceps of a user, comprising:

a support harness, comprising:

a substantially continuous neck band and pectoral portions, said neck band portions, having a right extremity and a left extremity, and two segmented pectoral flap portions, each of said pectoral flap portion extending from one said extremity of said neck band portion toward a respective lower portion of said pectoral flap portion and extending over the shoulder and a respective clavicle of a user;

a pair of totally elastic elements, at least one said totally elastic element fixed secured, at an upper attachment means, to each of said pectoral flap portions, each of said totally elastic elements descending from said upper attachment means and having a lower region; and hand gripping means proximate to said lower region of each of said elastic elements and fixed thereto by a lower attachment means, and wherein said totally elastic elements have a degree of elasticity sufficient to elongate said totally elastic elements by a distance having a magnitude great enough to allow movement of said handgripping means away from said lower portion of said pectoral flap to achieve substantially full tricep contraction and substantially full arm extension from an initial position of lower arm retraction by pulling down on the hand gripping means against a resilient resisting force of said totally elastic elements.

2. The apparatus as recited in claim 1, wherein said neck band and said pectoral flaps together comprise a unitary structure.

3. The apparatus as recited in claim 1, wherein said pectoral flaps comprise individual structures separate from said neck band.

4. The apparatus as recited in claim 3, wherein said support harness comprises a central band, said neck band slideably mounted on said central band, and each said pectoral flap is secured to said central band.

5. The apparatus as recited in claim 4, further comprising at least one pair of padding elements, each padding element in each pair thereof slideably mounted on said central band and intervening between said neck band and one of said pectoral flap.

6. The apparatus as recited in claim 5, wherein said padding elements comprise two pairs thereof.

7. The apparatus as recited in claim 1, wherein said support harness comprises a flexible structure.

8. The apparatus as recited in claim 1, wherein said neck band comprises a structural layer and a compliant layer, the outer surface of said compliant layer secured to the inner surface of said structural layer.

9. The apparatus as recited in claim 8, wherein said neck band comprises a rigid structure.

10. The apparatus as recited in claim 9, wherein said support harness comprises a unitary rigid structure.

11. The apparatus as recited in claim 1, wherein each said elastic element comprises an elastic cord, each said elastic cord comprising:

an elongated member, said elongated member having an upper region and a lower region;

an upper cord stay secured to said elongated member at the upper region thereof; and a lower cord stay secured to said elongated member at the lower region thereof.

12. The apparatus as recited in claim 11, wherein said upper cord stay comprises an upper hook and said lower cord stay comprises a lower hook.

13. The apparatus as recited in claim 12, wherein said upper attachment means comprises a grasping hook, and said upper hook is looped over said grasping hook.

14. The apparatus as recited in claim 13, wherein said hand gripping means comprises a hand stirrup, and said lower hook is looped over a portion of said hand stirrup.

15. The apparatus as recited in claim 14, wherein said hand stirrup comprises a D-shaped member having an upper loop positioned at a curved portion of said D-shaped member, and said lower hook is looped over said upper loop.

16. The apparatus as recited in claim 1, wherein said elastic element comprises a plurality of elongated elastic members.

17. The apparatus as recited in claim 11, wherein said elastic element comprises a plurality of said bungee cords.

18. The apparatus as recited in claim 1, wherein each said upper attachment means comprises a plurality of grasping hooks, said grasping hooks positioned sequentially on each respective one of said pectoral flaps, in increasing distance from said neck band.

19. An apparatus for exercising the triceps, comprising:

a support harness, said support harness comprising:

a central band having a right end region and a left end region, a neck band, said neck band supported on said central band between said right end region and said left end region, and a pair of pectoral flaps, one said pectoral flap secured to said central band at said right end region and the other said pectoral flap secured to said central band at said left end region, at least a portion of said central band being within each said pectoral flap;

at least one pair of padding elements, each padding element in a pair thereof slideably mounted on said central band and positioned between said neck band and one of said pectoral flaps;

a pair of grasping hooks, one such grasping hook secured to each said pectoral flap;

a pair of elastic elements, each said elastic element having an upper region and a lower region, each said elastic element, at said upper region thereof, secured to one said grasping hook and descending therefrom;

a pair of hand stirrups, each said hand stirrup proximate to said lower region of one said elastic member; and a lower attachment means securing each said elastic element, at said lower region thereof, to a respective one of said hand stirrups.

20. An apparatus for exercising the triceps, comprising:

a unitary, flexible support harness, said support harness comprising:

a neck band having a right extremity and a left extremity, said neck band comprising a structural layer and a compliant layer, said structural layer having an inner surface and an outer surface, a surface of said compliant layer secured to the inner surface of said structural layer, and a pair of pectoral flaps, integral with said neck flap, each said pectoral flap extending from one said extremity of said neck band toward a lower portion of said pectoral flap;

a plurality of grasping hooks, at least two said grasping hooks secured to each of said pectoral flaps at said lower portion thereof and positioned sequentially on the respective one of said pectoral flaps, in increasing distance from said neck band;

a pair of elastic elements, each said elastic element having an upper region and a lower region, each said elastic element secured to one of said grasping hooks at its upper region and descending therefrom;

a pair of hand stirrups, each said hand stirrup proximate to said lower region of each said lower region of one said elastic element; and a lower attachment means securing each said elastic element, at said lower region thereof, to a respective one of said hand stirrups.

21. An apparatus for exercising the triceps, comprising:

a support harness, comprising:

a neck band having a right extremity and a left extremity, and two segmented pectoral flaps, each of said pectoral flaps extending from one said extremity of said neck band toward a respective lower portion of said pectoral flap;

at least one pair of padding elements, each padding element slideably mounted on said neck band and intervening between said neck and one of said pectoral flaps an upper attachment means secured to each of said pectoral flaps at said lower portion thereof;

an elastic element secured to each of said pectoral flaps, by said upper attachment means, at said lower portion of said pectoral flap, each of said elastic elements descending from said upper attachment means and having a lower region;

hand gripping means proximate to said lower region of each of said elastic elements; and a lower attachment means securing each of said elastic elements, at the lower regions thereof, to a respective one of said hand gripping means.

22. The apparatus of claim 21, wherein said padding elements comprise two pairs thereof.

23. An apparatus for exercising the triceps, comprising:

a support harness, comprising:

a neck band having a right extremity and a left extremity, and two segmented pectoral flaps, each of said pectoral flaps extending from one said extremity of said neck band toward a respective lower portion of said pectoral flap;

a plurality of grasping hooks, said grasping hooks positioned sequentially on each respective one of said pectoral flaps, in increasing distance from said neck band and secured to each of said pectoral flaps at said lower portion thereof;

an elastic element secured to each of said pectoral flaps, by said upper attachment means, at said lower portion of said pectoral flap, each of said elastic elements descending from said upper attachment means and having a lower region;

hand gripping means proximate to said lower region of each of said elastic elements; and a lower attachment means securing each of said elastic elements, at the lower regions thereof, to a respective one of said hand gripping means.

* * * * *